US009457368B2

(12) United States Patent
Gonzales et al.

(10) Patent No.: US 9,457,368 B2
(45) Date of Patent: Oct. 4, 2016

(54) FLUIDIC DEVICES, BUBBLE GENERATORS AND FLUID CONTROL METHODS

(75) Inventors: Curt Gonzales, Corvallis, OR (US); Ralph L. Stathem, Lebanon, OR (US); David Olsen, Corvallis, OR (US); Marc A. Baldwin, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 378 days.

(21) Appl. No.: 14/007,275

(22) PCT Filed: Mar. 31, 2011

(86) PCT No.: PCT/US2011/030785

§ 371 (c)(1),
(2), (4) Date: Sep. 24, 2013

(87) PCT Pub. No.: WO2012/134486

PCT Pub. Date: Oct. 4, 2012

(65) Prior Publication Data

US 2014/0263701 A1 Sep. 18, 2014

(51) Int. Cl.

| | |
|---|---|
| ***B05B 7/24*** | (2006.01) |
| ***B41J 2/175*** | (2006.01) |
| *B41J 2/19* | (2006.01) |

(52) U.S. Cl.

CPC ..... *B05B 7/2483* (2013.01); *B41J 2/175* (2013.01); *B41J 2/19* (2013.01)

(58) Field of Classification Search

CPC ..... B41J 2/19; B41J 2/175; B05B 7/2483
See application file for complete search history.

(56) References Cited

U.S. PATENT DOCUMENTS 4,920,362 A * 4/1990 Cowger ..... B41J 2/17513 347/87
4,929,963 A * 5/1990 Balazar ..... B41J 2/1707 347/89
5,010,354 A 4/1991 Cowger et al.
5,103,243 A * 4/1992 Cowger ..... B41J 2/17513 347/87
5,119,116 A * 6/1992 Yu ..... B41J 2/1604 347/45
5,526,030 A * 6/1996 Baldwin ..... B41J 2/17506 347/87
5,576,749 A 11/1996 Mochizuki et al.
5,600,358 A 2/1997 Baldwin et al.
5,729,261 A * 3/1998 Burke ..... B41J 2/14129 347/45
5,777,649 A * 7/1998 Otsuka ..... B41J 2/055 347/92
5,886,721 A * 3/1999 Fujii ..... B41J 2/17513 347/87

(Continued)

FOREIGN PATENT DOCUMENTS

EP 0709212 A1 * 5/1996 ..... B41K 2/19
JP 2006315302 A * 11/2006

OTHER PUBLICATIONS

International Search Report, issued by the Korean Intellectual Property Office in connection with International Patent Application No. PCT/US2011/030785, on Dec. 20, 2011, 7 pages.

*Primary Examiner* — Amber R Orlando
*Assistant Examiner* — Stephen Hobson
(74) *Attorney, Agent, or Firm* — HP Inc. Patent Department

(57) ABSTRACT

Example fluidic devices and methods are described. An example device includes a throughput chamber, an inlet to guide liquid in the throughput chamber and an outlet to guide liquid out of the throughput chamber. The example device also includes a rib that protrudes from a wall of the throughput chamber. The rib has a narrowed section in the throughput chamber between the inlet and the outlet to form a meniscus in the narrowed section.

20 Claims, 8 Drawing Sheets

(56) References Cited

U.S. PATENT DOCUMENTS 5,909,231 A * 6/1999 Childers ..... B41J 2/19 347/85
6,102,517 A * 8/2000 Kobayashi ..... B41J 2/175 347/23
6,158,855 A * 12/2000 Saikawa ..... B41J 2/17513 347/92
6,176,573 B1 * 1/2001 Barth ..... B41J 2/17513 347/92
6,464,346 B2 10/2002 Otis, Jr. et al.
6,508,541 B1 * 1/2003 Andrews ..... B41J 2/1404 347/20
6,910,760 B2 * 6/2005 Kubota ..... B41J 2/1404 347/56
6,957,882 B2 * 10/2005 Wouters ..... B41J 2/17513 347/86
7,168,788 B2 * 1/2007 Barss ..... B41J 2/1433 347/45
7,669,996 B2 * 3/2010 Brown ..... B41J 2/14 347/42
7,819,515 B2 10/2010 Silverbrook et al.
7,824,175 B2 11/2010 Dominka
8,690,302 B2 * 4/2014 Paschkewitz ..... B41J 2/0057 347/85
9,205,666 B2 * 12/2015 Yoshii ..... B41J 2/19
2001/0009432 A1 7/2001 Olsen et al.
2002/0186283 A1 * 12/2002 Smith ..... B41J 2/19 347/68
2003/0128256 A1 7/2003 Oda et al.
2007/0291090 A1 * 12/2007 Kusunoki ..... B41J 2/1404 347/92
2008/0143774 A1 * 6/2008 Morgan ..... B41J 2/175 347/17
2008/0180493 A1 7/2008 Ogle et al.
2009/0051055 A1 2/2009 Park
2009/0073217 A1 * 3/2009 Yaneda ..... B41J 2/175 347/30
2009/0219352 A1 9/2009 Silverbrook
2009/0322840 A1 * 12/2009 Wanibe ..... B41J 2/17559 347/92
2011/0221838 A1 * 9/2011 Oguchi ..... B41J 2/19 347/93
2012/0056938 A1 * 3/2012 Ishizawa ..... B41J 2/175 347/44
2013/0194360 A1 * 8/2013 Nakao ..... B41J 2/14274 347/92
2015/0085034 A1 * 3/2015 Aruga ..... C09D 11/38 347/93
2015/0321483 A1 * 11/2015 Yoshii ..... B41J 2/1752 347/86
2016/0059576 A1 * 3/2016 Ito ..... B41J 2/17523 347/93

* cited by examiner

FLUIDIC DEVICES, BUBBLE GENERATORS AND FLUID CONTROL METHODS

RELATED APPLICATION

This patent arises from the U.S. national stage of International Patent Application Serial No. PCT/US2011/030785, having an International Filing Date of Mar. 31, 2011, which is hereby incorporated by reference in its entirety.

BACKGROUND

Certain devices are designed to guide a liquid through an inlet and out of an outlet. Such devices may be designed for at least one of liquid circulation, liquid ejection, liquid storage, etc. In certain examples of these devices, a gas intentionally or unintentionally flows into the inlet during usage or between usages, in addition to the liquid. These gases can affect a pressure in the device.

BRIEF DESCRIPTION OF THE DRAWINGS

For the purpose of illustration, certain examples constructed in accordance with the teachings of the present disclosure will now be described with reference to the accompanying diagrammatic drawings, in which.

DETAILED DESCRIPTION

In the following detailed description, reference is made to the accompanying drawings. The examples in the description and drawings should be considered illustrative and are not to be considered as limiting to the specific example element described. Multiple examples may be derived from the following description and/or drawings through modification, combination or variation of certain elements. Furthermore, it may be understood that other examples or elements that are not literally disclosed may be derived from the description and drawings by a person skilled in the art.

Figure 1:
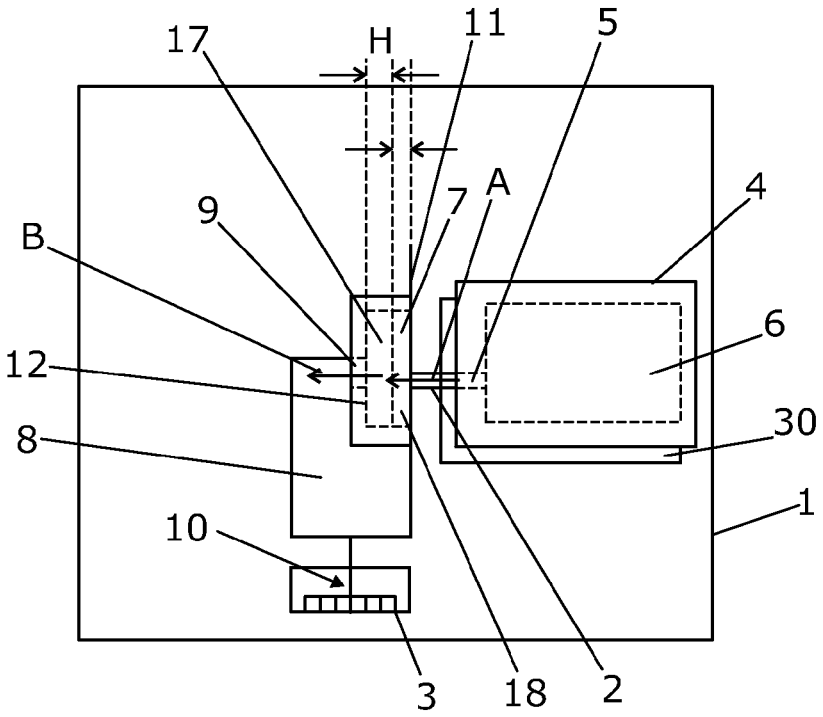
FIG. 1 shows a diagram in side view of an example fluidic device.

FIG. 1 shows an example a fluidic device 1 in a side view. In the shown example, the fluidic device 1 includes a liquid ejector 3 for ejecting liquid. In a further example, the fluidic device 1 includes a printer, for example an inkjet printer.

Other example fluidic devices 1 according to this disclosure may include a fluid dispensing device, a fluid administration device or a fluid circulation device. These example devices may handle a fluid that includes liquid and/or gas. In a further example, the liquid includes ink and the gas includes air.

In the example illustrated in FIG. 1, the fluidic device 1 includes an inlet 2 that is arranged to receive liquid from a supply 4. The supply 4 is arranged to be exchanged with respect to the inlet 2. The supply 4 includes a supply outlet 5 and a reservoir 6 for holding a substance including liquid. In the illustrated example, the inlet 2 includes a needle that, in a connected state, extends through the supply outlet 5 for guiding the liquid out of the supply 4 and into the fluidic device 1. A cradle 30 may be provided for receiving the supply 4. The cradle 30 may be arranged on or off-axis. In the illustrated example, the cradle 30 is arranged off axis. The supply 4 may include any type of fluid supply such as, for example, a supply including a printing liquid such as ink or a supply including a pharmaceutical liquid or another type of supply.

The example fluidic device 1 includes a throughput chamber 7. The inlet 2 is arranged to guide the liquid into the throughput chamber 7 in a direction shown by arrow A. In the illustrated example, the fluidic device 1 also includes a further liquid chamber 8. In addition, as shown in the illustrated example, the fluidic device 1 further includes an outlet 9 for guiding liquid out of the throughput chamber 7 and into the liquid chamber 8 in a direction shown by arrow B. The liquid ejector 3 is arranged to eject the liquid out of the liquid chamber 8, for example through at least one conduit 10. In certain examples of the fluidic device 1, the liquid ejector 3 includes a print head with nozzles for ejecting printing liquid. An example printhead may include a scanning printhead and/or a page wide array printhead.

Figure 2:
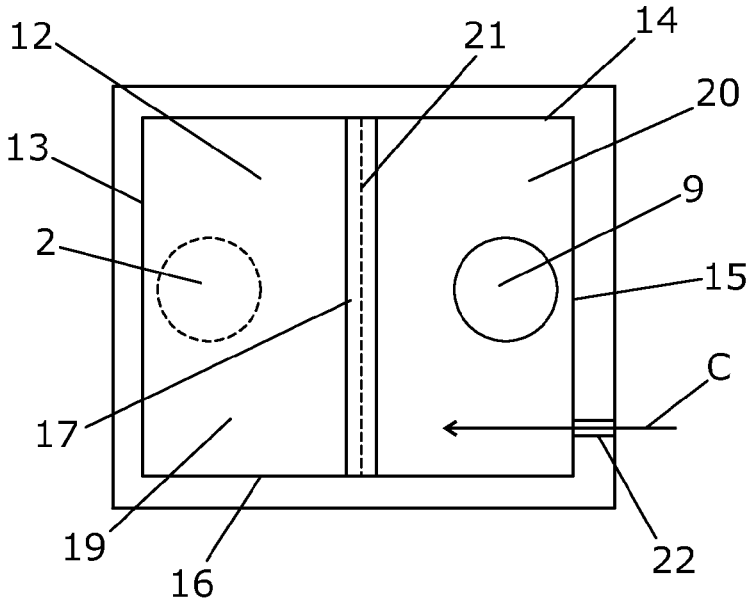
FIG. 2 shows a diagram in front view of an example bubble generator.

FIG. 2 shows a front view of the example throughput chamber 7 of FIG. 1. As shown in FIGS. 1 and 2, the throughput chamber 7 is defined by a front wall 11, a back wall 12 and side walls 13, 14, 15, 16. A rib 17 is provided that protrudes from the back wall 12, towards the front wall 11. A top edge of the rib 17 and the front wall 11 define a narrowed section 18 in the chamber 7. In the illustrated example, the rib 17 is arranged between the inlet 2 and the outlet 9 so that, in use, liquid flows into the throughput chamber 7 through the inlet 2, over the rib 17 and exits through the outlet 9. The rib 17 is arranged so that liquid can freely flow through the narrowed section 18 when the throughput chamber 7 is filled.

In the illustrated example, the rib 17 extends across the entire throughput chamber 7. For example, the rib 17 may divide the throughput chamber 7 into an upstream chamber 19 and a downstream chamber 20. The upstream chamber 19 and the downstream chamber 20 are fluidically connected to each other through the narrowed section 18. The inlet 2 opens into the upstream chamber 19. The outlet 9 opens into the downstream chamber 20. In an example, the outlet 9 fluidically connects the downstream chamber 20 with the liquid chamber 8.

In some examples, liquid is supplied to the throughput chamber 7 to fill the throughput chamber 7 with liquid. In other examples, where no liquid is supplied to the throughput chamber 7, a gas may flow into the throughput chamber 7 such as, for example, through the inlet 2. For example, gas may flow into the throughput chamber 7 when the supply 4 is disconnected from the inlet 2.

When gas flows into the throughput chamber 7, a meniscus 21 is formed along the rib 17, spanning the narrowed section 18. In FIG. 2, the meniscus 21 is diagrammatically indicated by a dotted line. The meniscus 21 impedes the gas to flow through the narrowed section 18.

The meniscus 21 may allow passage of a certain amount of gas when a certain pressure difference between both sides of the meniscus is exceeded. For example, the pressure difference may be built up through relatively non-controlled factors occurring at the downstream side of the rib 17 such as, for example, temperature changes, liquid evaporation, liquid leakage, chemical reactions, etc. When the pressure difference is exceeded, the gas may press through the meniscus 21, forming a bubble. The passing through of the bubble causes the pressure difference to decrease again and the meniscus may close again, preventing further gas flow until said pressure difference is exceeded again, and again a bubble passes through. For example, this cycle may repeat itself, thus maintaining a pressure on the downstream side of the rib 17 (e.g. the downstream chamber 20, outlet 9, liquid chamber 8, conduit 10 and/or ejector 3) within a suitable range, at least during a certain time period.

In a further example, the fluidic device 1 includes a capillary liquid feed arrangement 22 for feeding liquid to the rib 17, in a direction shown by arrow C. In the illustrated example, the capillary liquid feed arrangement 22 includes a capillary channel opening into the throughput chamber 7. The capillary liquid feed arrangement 22 is arranged to draw liquid into the throughput chamber 7 through capillary action. The liquid may be drawn from the liquid chamber 8.

At a point of first gas entry, the rib 17 may be directly wetted through the liquid present in the outlet chamber portion 20. When a liquid level in the outlet chamber portion 20 has dropped, the rib 17 may be wetted through capillary action of the capillary liquid feed arrangement 22. In some examples, the capillary liquid feed arrangement 22 draws the liquid out of the liquid chamber 8.

In some examples, a height H of the rib 17 is adapted to form a narrowed section 18 having a gap size GS. The gap size GS may be determined by the gap between the top edge of the rib 17 and the front wall 11. In some examples, the front wall 11 of the fluidic device engages the front face 24 of a bubble generator 23, so that the gap size GS may be equal to the height difference between a top edge of the rib 17 and the front face 24 of the bubble generator 23. The height H of the rib 17 is adapted to allow liquid to flow over the rib 17 when liquid flows through the inlet 2, and to form a meniscus 21 when the inlet 2 is open to gas.

Figure 3:
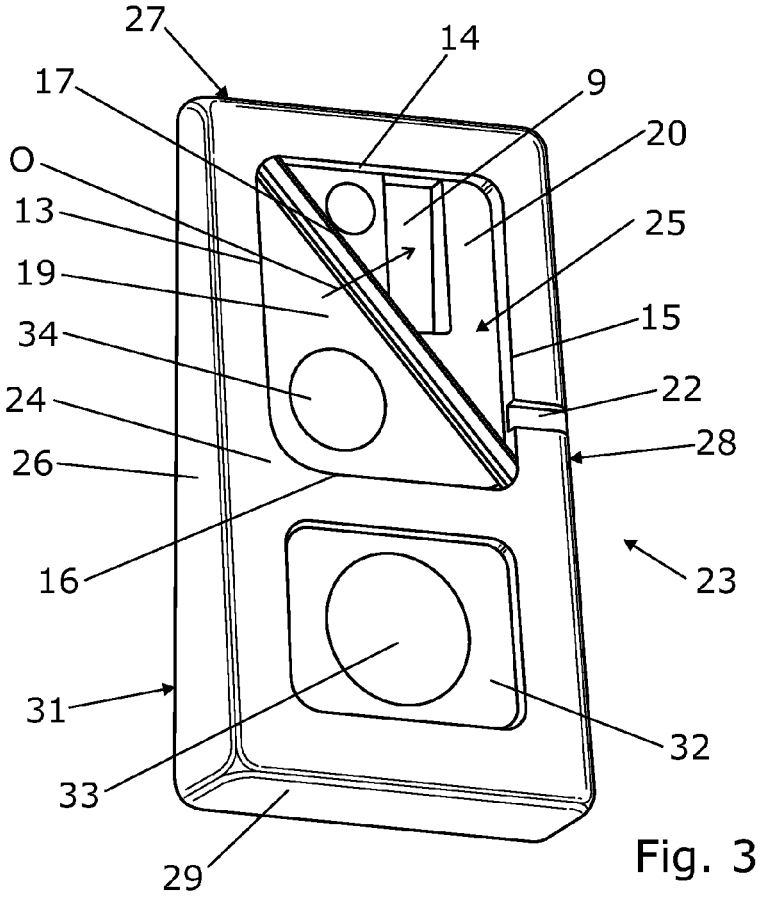
FIG. 3 shows a perspective view of the example bubble generator of FIG. 2.

FIG. 3 shows a perspective view, mainly showing a front of an example of a bubble generator 23. The bubble generator 23 is adapted to be installed in the fluidic device 1 for forming the throughput chamber 7. The bubble generator 23 includes a front face 24 for engaging a wall 11 of the fluidic device 1. The bubble generator further includes side faces 26, 27, 28, 29, and a back face 31. The bubble generator 23 also includes a recess 25. The recess 25 is provided in the front face 24. When the bubble generator 23 is installed, the front face 24 engages the front wall 11 as illustrated in FIG. 1, so that the front wall 11 covers the recess 25 and the throughput chamber 7 is formed. The recess 25 is defined by the back wall 12, and side walls 13, 14, 15, 16.

The bubble generator 23 is provided with the outlet 9, extending through the back wall 12. The outlet 9 opens into the recess 25. The rib 17 is provided within the recess 25, next to the outlet 9, having a height H that is lower than the front face 24. The height difference between the rib's top edge and the front wall 11 may be equal to the gap size GS. By having the height H lower than the front face 24, the narrowed section 18 between a top edge of the rib 17 and the engaging wall 11 of the fluidic device 1 is formed. The height of the rib 17 is adapted to allow the meniscus formation between the top edge and the front wall 11 of the fluidic device 1 when liquid is supplied to one side of the rib 17 and gas to the other side of the rib 17.

In the example bubble generator 23, the rib 17 is arranged across the entire recess 25. In the illustrated example, the rib 17 extends diagonally across the recess 25. The rib 17 divides the throughput chamber 7 into an upstream chamber 19 and a downstream chamber 20. The inlet 2 and the upstream chamber 19 of the recess 25 are provided on the upstream side of the rib 17. The downstream chamber 20, the outlet 9 and the capillary liquid feed arrangement 22 are provided on the downstream side of the rib 17.

The capillary liquid feed arrangement 22 opens into the recess 25, through the sidewall 15. The capillary liquid feed arrangement 22 includes a cut out in the front face 24 and the side wall 28. The cut out forms a capillary channel to the downstream chamber 20. The capillary liquid feed arrangement 22 opens into the downstream chamber 20. In the illustrated example, the capillary feed arrangement 22 includes a capillary channel that is separate from the outlet 9. The recess 25 is arranged to receive incoming liquid in the upstream chamber 19 of the rib 17 so that the incoming liquid and/or gas flows over the rib 17 towards the outlet 9, in a direction of the arrow O.

The example bubble generator 23 comprises a molded cast. In some examples, the bubble generator 23 comprises a singly molded cast. Also, in some examples, the bubble generator 23 is injection molded. In the illustrated example, the bubble generator 23 also includes a second recess 32. The second recess 32 may function as a pocket for an ejector pin flash 33. This configuration may allow the front face 24 to be pressed flat against the respective wall 11 of the fluidic device. Also, the main recess 25 may include an ejector pin flash 34.

Figure 4:
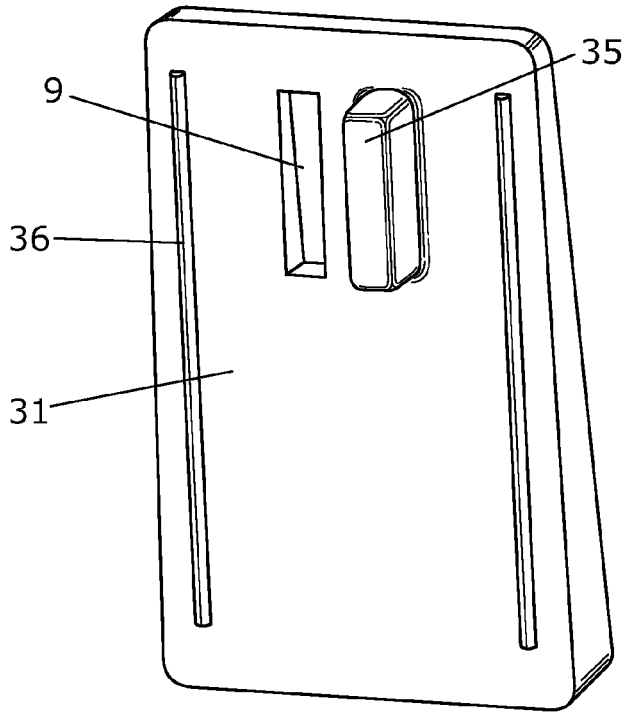
FIG. 4 shows another perspective view of the example of FIG. 2.

FIG. 4 shows a view on the back face 31 of the example bubble generator 23. The illustrated example of the bubble generator 23 includes an alignment notch 35. The alignment notch 35 is arranged to provide alignment for proper installation of the generator 23 in the fluidic device 1. The alignment notch 35 may be arranged on the back face 31, as shown in FIG. 4. Furthermore, the example bubble generator 23 includes protrusions 36, arranged to deform for press-fitting the bubble generator 23 in the fluidic device 1 to enable the front face 24 to be pushed against the respective wall 11 of the fluidic device 1. In the illustrated example, the protrusions 36 comprise crush ribs that are arranged on the back face 31.

The example bubble generator 23 is a separate part that can be installed in the fluidic device 1. In other examples, the bubble generator 23 forms an integrated element of the fluidic device 1, for example molded together with further parts. In yet further examples, the bubble generator 23 may include multiple separately molded parts.

Figure 5:
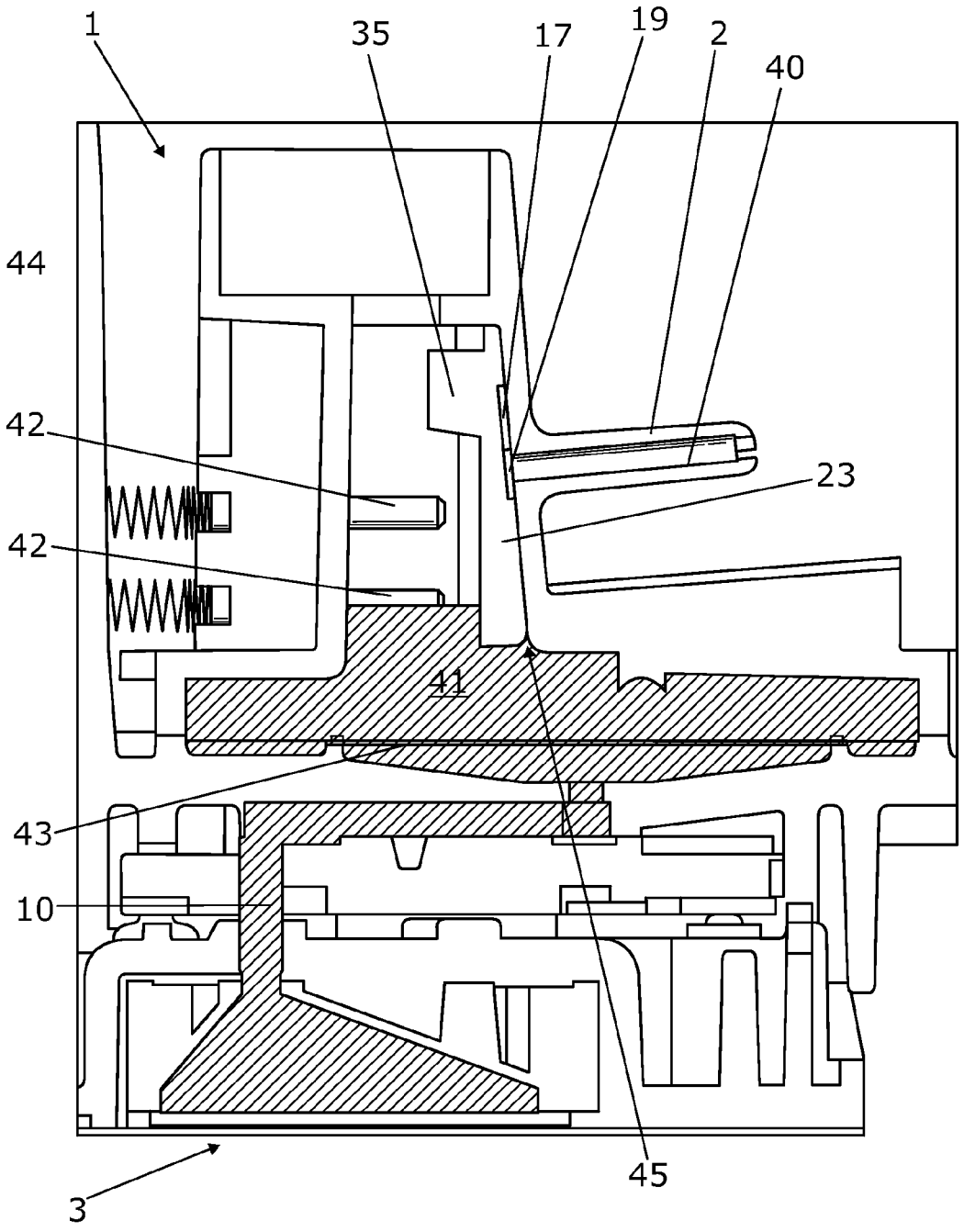
FIG. 5 shows a cross sectional side view of a part of the example fluidic device of FIG. 1.
Figure 6:
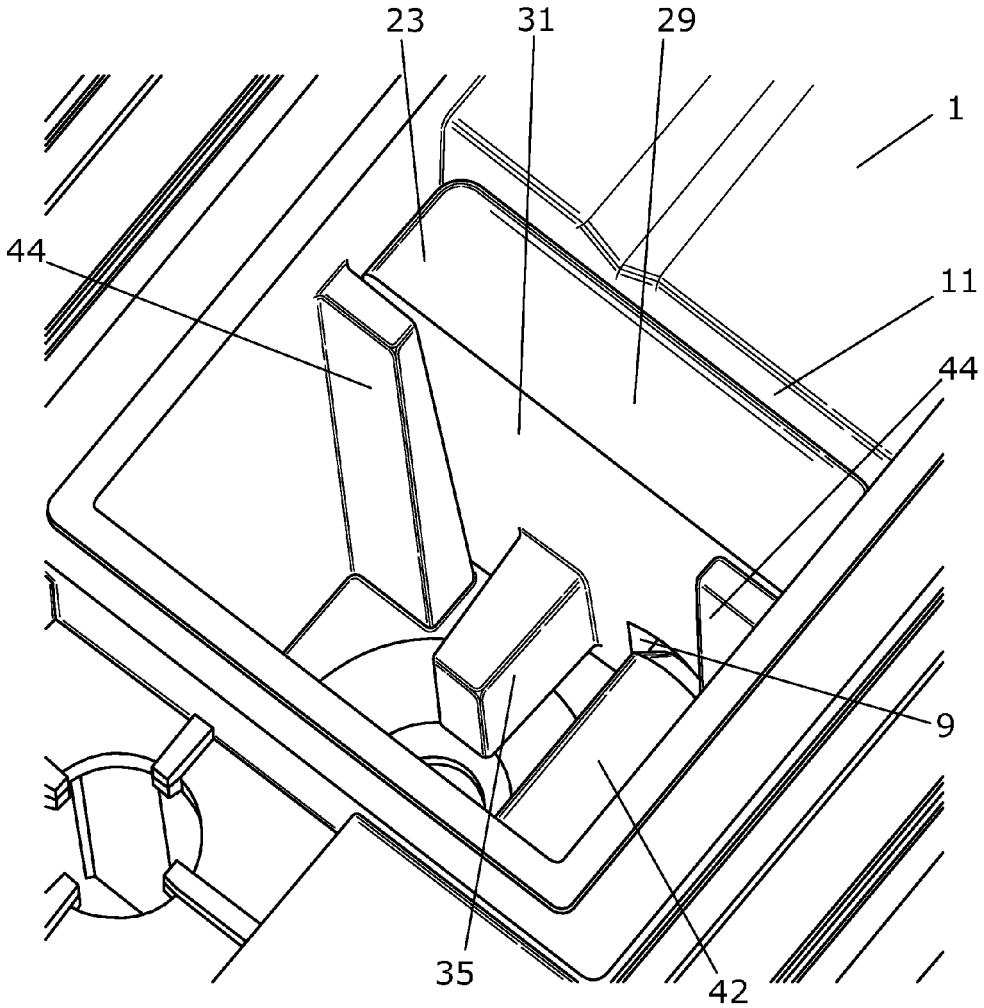
FIG. 6 shows a cross sectional perspective view of a part of the example of FIG. 1.

FIG. 5 shows the example fluidic device 1 in a cross sectional side view. In the illustrated example, the fluidic device 1 may be or may include a printer. The inlet 2 includes an inlet channel 40 that opens into the upstream chamber 19 of the throughput chamber 7. A part of the rib 17 also is shown in FIG. 5. The alignment notch 35 aligns the bubble generator 23 with respect to the fluidic device 1. The bubble generator 23 is mounted in the fluidic device 1 and is press-fitted between the front wall 11 and fitting walls 44 (FIG. 6). The protrusions 36 are crushed against the fitting walls 44.

In the illustrated example, the fluidic device 1 includes the liquid chamber 8. The liquid chamber 8 is shown in FIG. 5 partially filled with a liquid 41. In the illustrated example two liquid level sensors 42 are provided in the liquid chamber 8. The liquid sensors 42 may be configured to signal a presence of liquid. A filter 43 is provided between the liquid chamber 8 and the further conduits 10 to the liquid ejector 3.

In an example, when a supply 4 is disconnected from the inlet 2, remaining liquid in the inlet 2 and upstream chamber 19 may be pulled over the rib 17. Air may flow through the inlet 2 and a water column height of the liquid 41 in the liquid chamber 8 may tend to decrease. Flow of air to the downstream side of the rib 17 may be impeded by the meniscus 21 because it requires too much pressure to break it. This may prevent drooling and/or draining of the liquid 41 out of the liquid ejector 3.

An example of the throughput chamber 7 may act as a flow restrictor in the sense that it may prevent drooling of the liquid out of the liquid ejector 3, and it may prevent gas flow over the rib 17. Certain examples of the fluidic device 1 include, in addition to the throughput chamber 7, one or more flow restrictors to prevent liquid from drooling out of the liquid ejector 3. For example, the filter 43, the supply 4, and/or nozzles of the liquid ejector 3 may comprise flow restrictors.

To keep the rib 17 wet, liquid 41 may be drawn out of the liquid chamber 8 by the capillary action of surfaces, grooves and/or trenches 45 arranged along the bubble generator 23 and the walls 11, 44 of the fluidic device 1 in the liquid chamber 8. Through capillary action, this liquid may be fed to the channel of the capillary liquid feed arrangement 22, which in turn may feed the liquid to the rib 17 through further capillary action.

In the example of FIG. 6, a cross sectional, perspective view on the bottom side 29 and back face 31 of the bubble generator 23, fitted in the fluidic device 1, is shown. The bubble generator 23 is mounted in the fluidic device 1 and is fitted in the fluidic device 1 between the two fitting walls 44 and the front wall 11. The protrusions 36 are crushed against the fitting walls 44, as described above. The alignment notch 35 may also engage a respective wall of the fluidic device 1. FIG. 6 also shows a portion of the outlet 9 and a portion of one of liquid level sensors 42.

Figure 7:
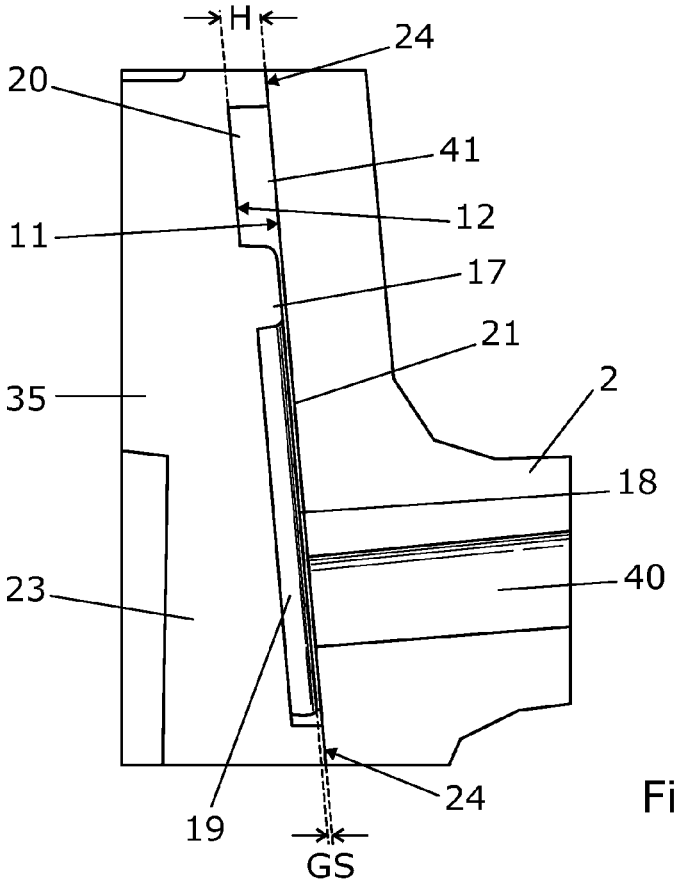
FIG. 7 shows a more detailed cross sectional side view of the example of FIG. 1.

In the example of FIG. 7, a cross sectional side view of a portion of the fluidic device 1 with the bubble generator 23 is shown. In the illustrated example, liquid 41 is provided in the throughput chamber 7. Also, as shown, some liquid 41 is provided in the downstream chamber 20 of the throughput chamber 7. The liquid 41 forms a meniscus 21 in the narrowed section 18, along the rib 17.

The narrowed section 18 has a gap size GS defined by the distance between a top edge of the rib 17 and the opposite front wall 11. The gap size GS is determined by the height H of the rib 17. The gap size GS controls the pressure difference between both sides of the meniscus 21, needed for gas to pass through the meniscus 21. If the pressure difference between both sides of the meniscus 21 is referred to as bubble pressure, the relation between the gap size GS and the bubble pressure may be defined by:

$$\text{Bubble Pressure}=2*Ts/GS$$

wherein Ts is surface tension. The gap size GS can be chosen according to a surface tension of the particular liquid and the desired bubble pressure.

In one example, a suitable gap size GS may be set at approximately 0.15 millimeter. In another example, the gap size GS may be set at approximately 0.1 millimeter. In yet another example, the gap size GS may be set at approximately 0.04 millimeter. In still another example, the gap size GS is between approximately 0.005 and approximately 0.5 millimeters. In a further example, the gap size GS is between approximately 0.01 and approximately 0.3 millimeters. The gap size GS may be equal to a height difference between a top edge of the rib 17 and the front face 24 of the bubble generator 23.

Figure 8:
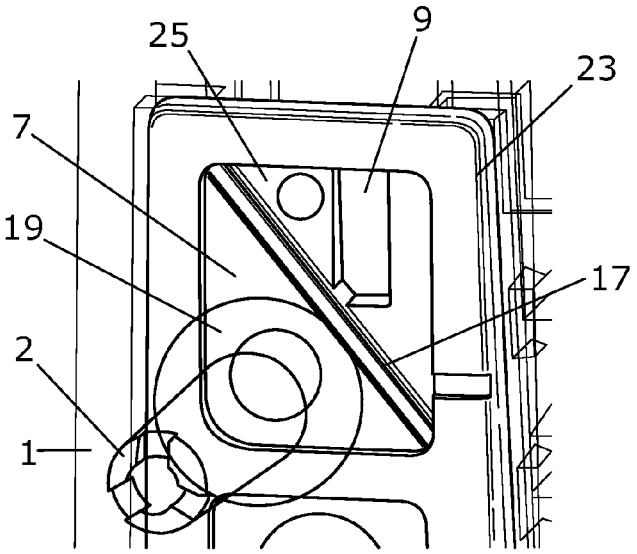
FIG. 8 shows a partly transparent perspective view of a detail of the example fluidic device of FIG. 1, in a first state.
Figure 9:
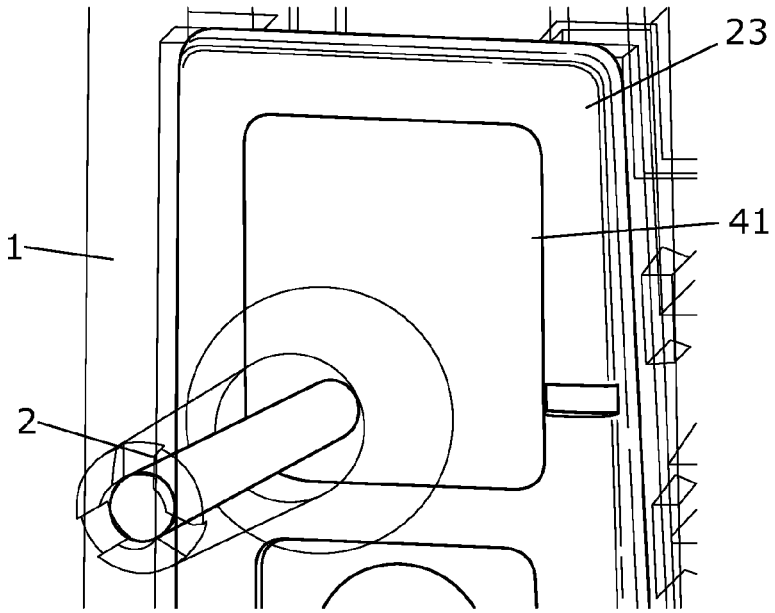
FIG. 9 shows the example of FIG. 8 in the same view, in a second state.
Figure 10:
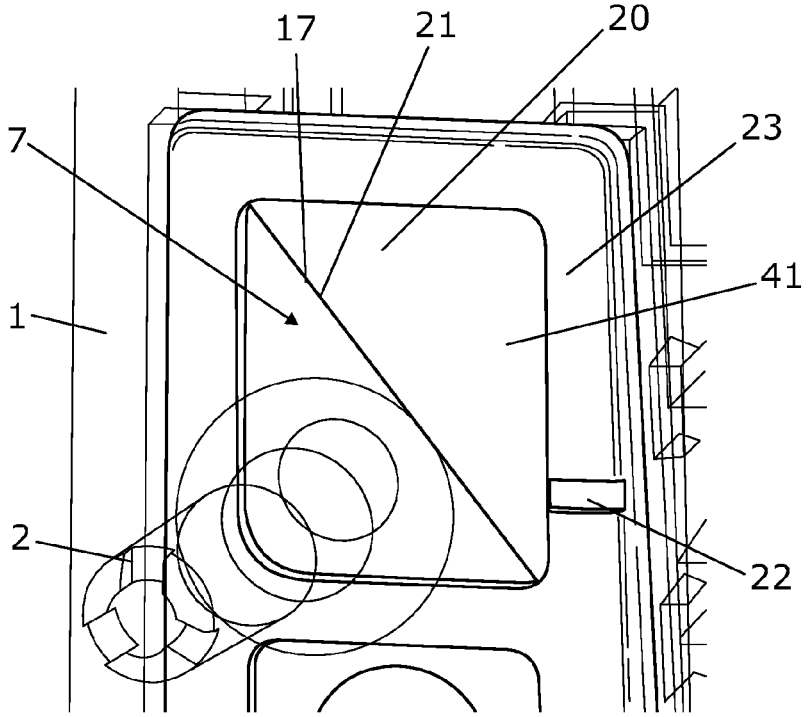
FIG. 10 shows the example of FIGS. 8 and 9 in the same view, in a third state.

FIGS. 8, 9 and 10 represent respective states of a portion of an example fluidic device 1, having the bubble generator 23 in place. In the drawings, the fluidic device 1 is transparent to show the bubble generator 23 and the liquid 41. FIG. 8 shows the bubble generator 23 within the fluidic device 1 without any liquid present in the system.

FIG. 9 shows a state of the fluidic device 1 of FIG. 8 wherein liquid 41 is supplied so that the inlet 2 and throughput chamber 7 are filled with the liquid 41. The liquid 41 flows over the rib 17 and through the outlet 9. FIG. 10 shows a state of the fluidic device 1 of FIGS. 8 and 9 wherein the liquid 41 has stopped flowing through the inlet 2. Gas is present in the inlet 2 and upstream chamber 19. The liquid 41 is pulled back to the rib 17. A meniscus 21 is formed along the rib 17 that prevents the gas from flowing over the rib 17. In later stages of the shown example of the fluidic device 1, the liquid 41 may exit the downstream chamber 20 through the outlet 9 and/or by evaporation, and the meniscus 21 is formed by liquid fed by the capillary liquid feed arrangement 22.

Figure 11:
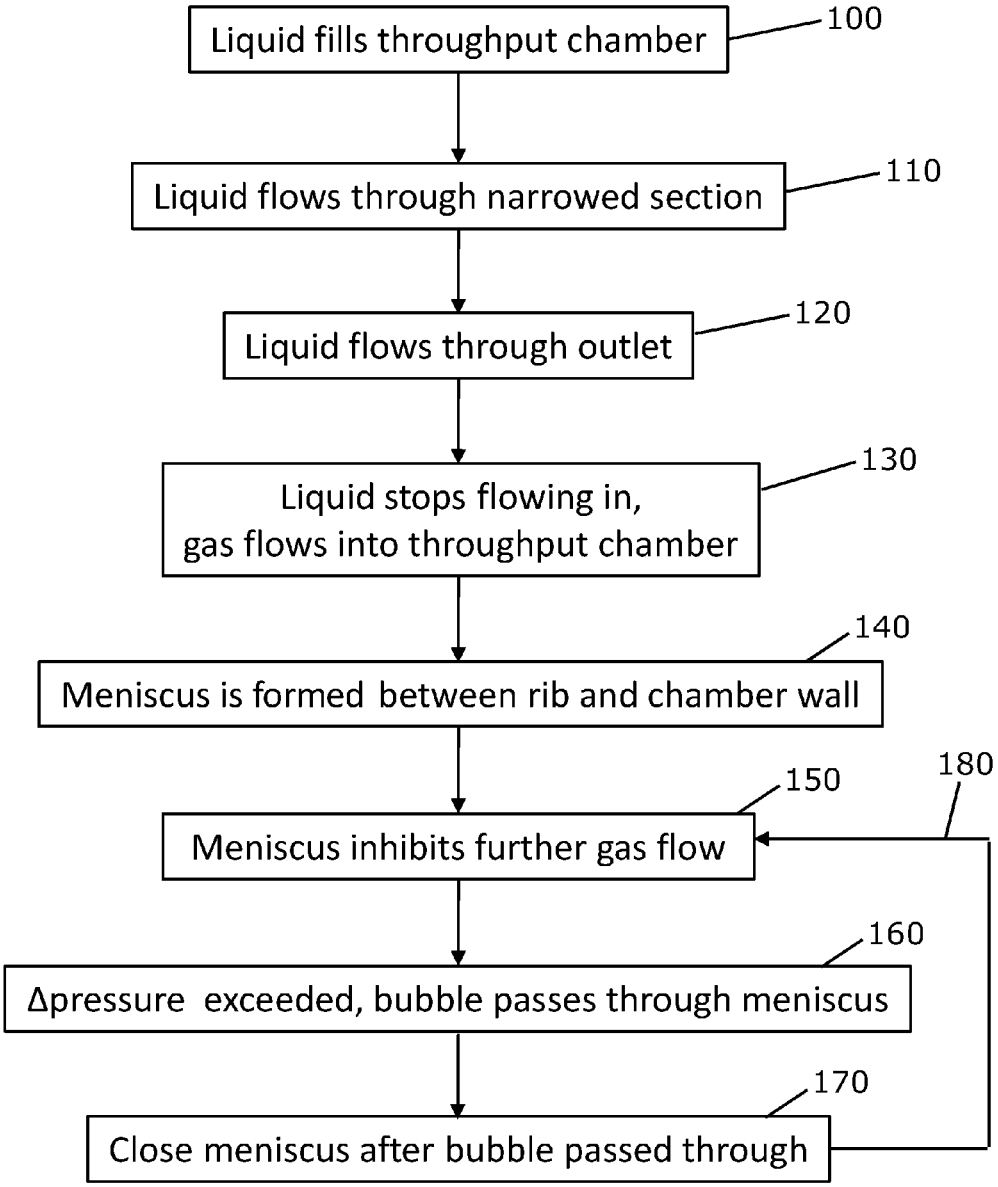
FIG. 11 is a flow chart of an example fluid control method.

FIG. 11 is a flow chart of an example fluid control method according to one or more of the examples described herein. In the example method, a liquid fills the throughput chamber 7 (block 100), for example through the inlet 2. The liquid flows through the narrowed section 18 (block 110), and the liquid flows through the outlet 9 (block 120). In accordance with the illustrated example, the liquid stops flowing into the throughput chamber 7 (block 130). Gas flows into the inlet 2 and the upstream chamber 19 (block 130). A meniscus 21 is formed between the rib 17 and the wall 11 (block 140), and the meniscus 21 inhibits gas from flowing over the rib 17 (block 150). A certain pressure difference between both sides of the meniscus 21 is needed for the gas to push through the meniscus 21. In an example, a pressure difference is built up between both sides of the meniscus 21. For example, the pressure difference may be built up through relatively non-controlled factors such as, for example, temperature changes in the liquid or gas, evaporation of liquid, leakage of liquid or gas, chemical reactions of the liquid and/or gas, etc. downstream of the rib 17. When the pressure difference is exceeded, gas passes through the meniscus 21, forming a bubble (block 160). The pressure difference decreases again once the gas bubble has passed through the meniscus 21. After the bubble has passed through, the meniscus closes again (block 170), and gas flow is again inhibited. As indicated by arrow 180, formation (block 150) and closure (block 170) of the meniscus 21 may repeat itself in cycles, as the pressure difference increases allowing bubble formation, and decreases when a bubble has passed through the meniscus 21.

Figure 12:
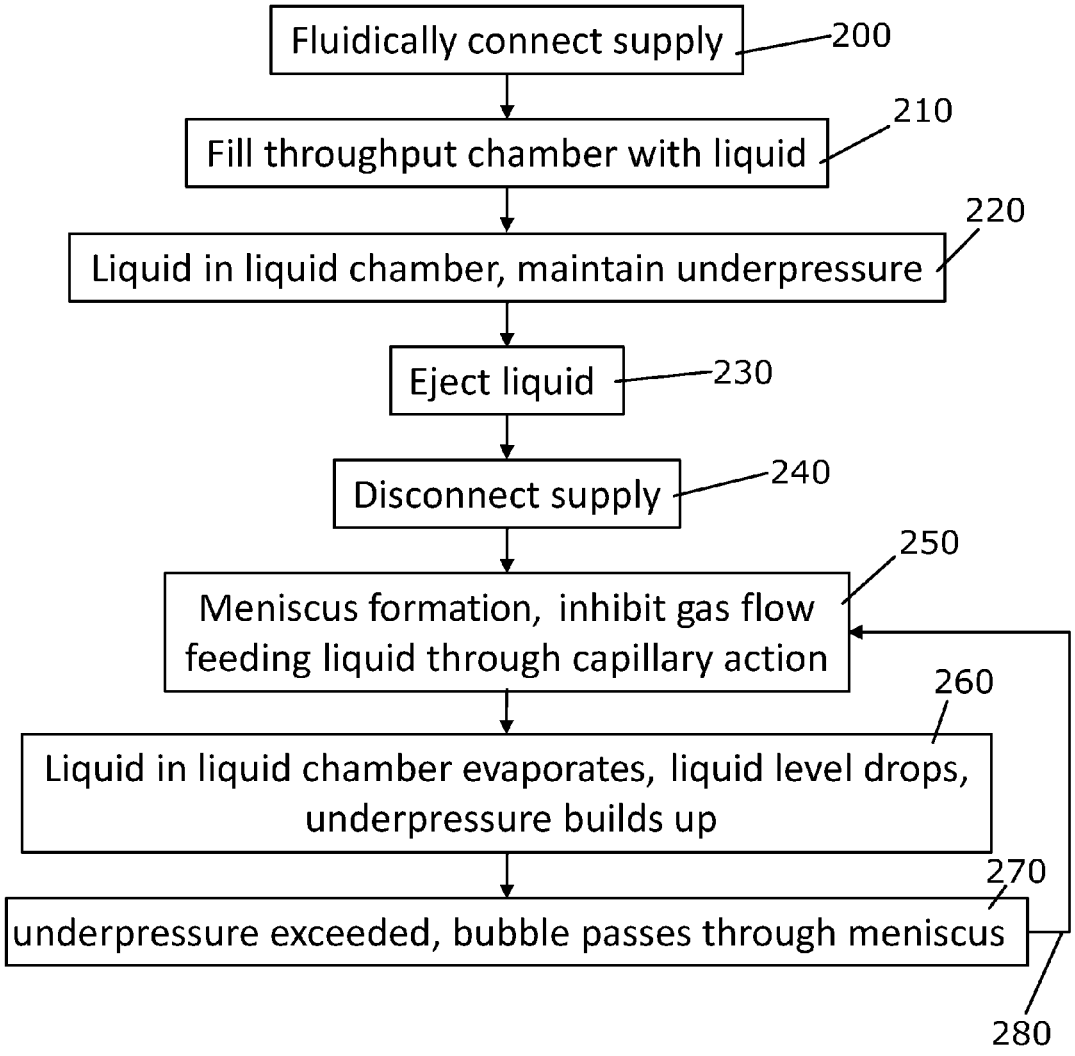
FIG. 12 is a flow chart of a further example fluid control method.

FIG. 12 is a flow chart of a further example fluid control method. In this example, the fluidic device 1 includes the liquid chamber 8 and the liquid ejector 3 equipped to maintain a suitable underpressure to prevent drooling out of the ejector 3.

The example method includes fluidically connecting the fluid supply 4 to the throughput chamber 7 (block 200), for example through the inlet 2. The throughput chamber 7 is filled with liquid out of the fluid supply (block 210). The liquid enters the upstream chamber 19, flows over the rib 17 and flows through the outlet 9 into the liquid chamber 8 (block 220), up to a certain liquid level. The sensors 42 may instruct the fluidic device 1 to continue the liquid flow up to a certain level. The example method also includes ejecting the liquid out of the liquid chamber 8 (block 230), for example through the liquid ejector 3. The supply 4 is disconnected from the throughput chamber 7 (block 240), and gas may flow into the throughput chamber 7. The meniscus 21 may form along the rib 17 (block 250), as explained above with reference to FIG. 11. The gas is inhibited from flowing over the rib 17 by the meniscus 21.

As a consequence of liquid flowing out of the downstream chamber 20, liquid may need to be fed to the rib 17. The capillary liquid feed arrangement 22 feeds liquid out of the liquid chamber 8 to the rib 17 by capillary action (block 250). The liquid in the liquid chamber 8 evaporates in time (block 260), and, consequently, a liquid level and water column height decreases, building up the underpressure that is present in the liquid chamber 8. Here, building up an underpressure should be understood as a decrease in pressure. Further relatively non-controlled factors such as temperature, chemical reactions, leakage, etc. may also affect said underpressure. The underpressure exceeds a certain height so that a gas bubble is pulled in through the meniscus 21 (block 270). Once the bubble has passed through, it causes the underpressure in the liquid chamber 8 to lower again so that the meniscus 21 can close again. After the gas bubble passed through (block 270), the meniscus closes again, as indicated by arrow 280 and block 250. The actions of blocks 250-270 repeat in cycles.

With this example method, an underpressure in the liquid chamber 8 may be kept within a suitable underpressure range that (i) is not too low, hence preventing drooling of liquid out of the device 1, and (ii) is not too high, to facilitate meniscus formation and inhibit gas flowing to the downstream side of the rib 17.

As can be seen from some of the discussed examples, the bubble generator 23 may comprise a single cast that can be readily molded and mounted. The bubble generator 23 may be used as a liquid and gas flow controlling part for any suitable fluidic device 1.

The above description is not intended to be exhaustive or limited to the examples disclosed. Other variations to the disclosed examples can be understood and effected by those skilled in the art from a study of the drawings, the disclosure, and the claims. The indefinite article "a" or "an" does not exclude a plurality, while a reference to a certain number of elements does not exclude the possibility of having more or less elements. A single unit may fulfill the functions of several items recited in the disclosure, and vice versa several items may fulfill the function of one unit. Multiple alternatives, equivalents, variations and combinations may be made without departing from the scope of the examples described herein.

What is claimed is:

1. A device comprising:

a throughput chamber defined by a first wall and a second wall spaced a distance from the first wall;

an inlet to guide liquid into the throughput chamber;

an outlet to guide liquid out of the throughput chamber into a liquid chamber in fluid communication with downstream conduits leading to a liquid ejector; and a rib having a first length extending along the first wall, the rib protruding from the first wall of the throughput chamber a second length less than the distance between the first wall and the second wall such that the rib and the second wall define a narrowed section in the throughput chamber, the narrowed section extending the first length of the rib, the rib having the second length to enable formation of a meniscus in the narrowed section along the first length of the rib when the inlet is exposed to gas.

2. The device according to claim 1, further including a capillary liquid feed arrangement that opens into the throughput chamber to feed liquid to the rib.

3. The device according to claim 2, wherein the capillary feed arrangement is arranged at a distance from the outlet at a same side of the rib as the outlet.

4. The device according to claim 1, wherein the inlet is arranged to receive liquid from an exchangeable fluid supply.

5. The device according to claim 1, wherein the rib having the second length is to:

allow formation of a bubble through the meniscus when a certain pressure difference is exceeded between both sides of the meniscus, and allow liquid to flow over the rib when liquid flows through the inlet.

6. The device according to claim 5, further including:

a liquid ejector; and a liquid chamber to hold liquid between the outlet and the liquid ejector, wherein the liquid chamber and the liquid ejector are arranged so that an underpressure in the liquid chamber prevents liquid from drooling out of the liquid ejector, and the bubble formation facilitates maintaining the underpressure within a range to prevent drooling.

7. The device according to claim 1, wherein the inlet is in one of the first wall or the second wall and the outlet is in the other one of the first wall or the second wall.

8. The device according to claim 1, further including a bubble generator having a front face to engage a surface of the device corresponding to the second wall, a recess in the front face to form the throughput chamber when the front face abuts the surface of the device.

9. The device according to claim 8, wherein the bubble generator includes a protrusion to deform when press-fitting the bubble generator against the surface of the device.

10. The device according to claim 1, wherein a difference between the second length of the rib and the distance between the first and second walls is between approximately 0.01 millimeters and approximately 0.3 millimeters.

11. A bubble generator to be installed in a fluidic device, the bubble generator comprising:

a front face to engage a first wall of the fluidic device;

a recess in the front face, the recess positioned to face a second wall spaced a distance from the first wall, the recess and the second wall to form a chamber when the front face abuts the first wall of the fluidic device;

an outlet in communication with the recess to guide liquid into a liquid chamber in fluid communication with downstream conduits leading to a liquid ejector; and a rib arranged within the recess next to the outlet, the rib having a first length extending along the second wall, the rib protruding from the second wall a second length less than the distance between the first wall and the second wall such that the rib and the first wall of the fluidic device define a narrowed section, the rib having the second length to enable formation of a meniscus in the narrowed section along the first length of the rib when gas is supplied to an upstream side of the rib.

12. The bubble generator according to claim 11, further including a capillary liquid feed arrangement in communication with the recess to supply liquid to the rib, the capillary feed arrangement arranged at a distance from the outlet at a same side of the rib as the outlet.

13. The bubble generator according to claim 11, further including at least one alignment notch for installation in the fluidic device.

14. The bubble generator according to claim 11, further including at least one protrusion to deform when press-fitting the bubble generator against the first wall of the fluidic device.

15. The bubble generator according to claim 11, wherein a height difference between the front face and a top edge of the rib is between approximately 0.01 millimeters and approximately 0.3 millimeters.

16. A fluid control method, comprising:

filling a throughput chamber with a liquid, the throughput chamber defined by a first wall and a second wall spaced a distance from the first wall;

flowing the liquid through a narrowed section defined by the second wall and a rib protruding from the first wall of the throughput chamber, the rib having a first length extending along the first wall, the rib protruding from the first wall a second length less than the distance between the first wall and the second wall to enable formation of a meniscus in the narrowed section along the first length of the rib;

flowing the liquid through an outlet into a liquid chamber in fluid communication with downstream conduits leading to a liquid ejector;

flowing a gas into the throughput chamber;

inhibiting the gas from flowing over the rib with the meniscus in the throughput chamber;

passing a bubble of the gas through the meniscus when a certain pressure difference between sides of the meniscus is exceeded; and closing the meniscus between the rib and an opposite wall after the bubble has passed through.

17. The method according to claim 16, further including:

flowing the liquid through the outlet into a liquid chamber when the throughput chamber is filled; and ejecting the liquid out of the liquid chamber.

18. The method according to claim 17, further including decreasing pressure in the liquid chamber to pull a bubble through the meniscus.

19. The method according to claim 16, further including:

fluidly connecting a supply of the liquid to the throughput chamber;

disconnecting the supply from the throughput chamber; and flowing the gas into the throughput chamber when the supply is disconnected.

20. The method according to claim 19, further including:

feeding liquid out of a liquid chamber to the rib by capillary action; and forming the meniscus with the fed liquid to inhibit gas flow.

* * * * *